US007162937B1

(12) United States Patent
Weng

(10) Patent No.: US 7,162,937 B1
(45) Date of Patent: Jan. 16, 2007

(54) POSITIONING DEVICE FOR A TWO-WAY RATCHET TOOL

(76) Inventor: Heng-Jian Weng, No. 12, Da Hui Rd. Jiang Du Town, Jiang Su Province, Jiang Du City (CN)

( * ) Notice: Subject to any disclaimer, the term of this patent is extended or adjusted under 35 U.S.C. 154(b) by 0 days.

(21) Appl. No.: 11/458,434

(22) Filed: Jul. 19, 2006

(51) Int. Cl.
*B25B 13/46* (2006.01)

(52) U.S. Cl. ..... 81/63.2; 81/63

(58) Field of Classification Search ..... 81/63, 81/63.2

See application file for complete search history.

(56) References Cited

U.S. PATENT DOCUMENTS 6,386,072 B1 * 5/2002 Yuan-Chin et al. ..... 81/63.2
6,408,722 B1 * 6/2002 Chen ..... 81/60
6,457,387 B1 * 10/2002 Hu ..... 81/63.2
6,568,299 B1 * 5/2003 Hu ..... 81/63.2
6,789,449 B1 * 9/2004 Liu ..... 81/63.2
7,017,453 B1 * 3/2006 Hu ..... 81/63.2
7,082,861 B1 * 8/2006 Chen ..... 81/63.2
7,096,763 B1 * 8/2006 Hsieh ..... 81/63.2
2003/0177872 A1 * 9/2003 Shu-Ying et al. ..... 81/63.2
2006/0090609 A1 * 5/2006 Chang ..... 81/63.2

* cited by examiner

*Primary Examiner*—David B. Thomas
(74) *Attorney, Agent, or Firm*—Anthony S. King; WPAT, P.C.

(57) ABSTRACT

A positioning device for a two-way ratchet tool includes a switch assembly, a lid, a ratchet, a detent and a wrench body. The switch assembly comprises a switch and a stud to be inserted in a through slot of the lid. The stud is provided with an engaging block to link the detent. The ratchet comprises a through hole therein and gear teeth around its outer periphery. The detent is formed with gear teeth. The ratchet and the detent are accommodated in the wrench body. A first elastic element is provided in the wrench body to engage with the detent so that the gear teeth of the detent mesh with the gear teeth of the ratchet. A second elastic element is provided in the wrench body to engage with the switch of the switch assembly.

4 Claims, 4 Drawing Sheets

POSITIONING DEVICE FOR A TWO-WAY RATCHET TOOL

BACKGROUND OF THE INVENTION

1. Field of the Invention

The present invention relates to a positioning device for a two-way ratchet tool, in particular to one having two elastic elements to control a detent and a switch assembly in position, respectively.

2. Description of the Prior Art

Wrench tools are popular in the market and each has its character, such as the U.S. Pat. Nos. 6,145,412 and 6,263,767 (all of which are incorporated herein by reference). The former uses gear teeth to secure a ratchet in position, which is complicated in structure. The latter cannot provide a precise position.

Other than the above-mentioned shortcomings, many of the prior art are incapable of securing the ratchet and be damaged.

SUMMARY OF THE INVENTION

It is the primary objective to provide a positioning device for a two-way ratchet tool comprising a switch assembly, a lid, a ratchet, a detent and a wrench body. The switch assembly comprises a switch and a stud extending from the switch. The stud is provided with an engaging block. The lid comprises a first reduced section, a through slot, and fastening member corresponding to the first reduced section. The fastening member is a C-shaped clip, and the first reduced section is also C-shaped. The through slot is for the stud to be inserted therethrough and to slide therein. The ratchet comprises a through hole, gear teeth and a second reduced section around its outer periphery. The detent comprises a front end, a relative rear end, and an upper side between the front and rear ends. The front end is formed with gear teeth. The upper side is formed with a trough to accommodate the engaging block of the stud. The wrench body comprises a chamber, a recess, a block ring, a groove, a first elastic element and a second elastic element. The recess interconnects with the chamber. The block ring is disposed in a lower portion of the wrench body, and the groove is disposed in an upper portion of the wrench body. The ratchet is accommodated in the chamber and blocked by the block ring. The detent is accommodated in the recess. The first elastic element is provided with a sleeve to engage with the detent so that the gear teeth of the detent mesh with the gear teeth of the ratchet. The lid is disposed on the second reduced section of the ratchet and covers the detent. The fastening member is disposed on the first reduced section of the lid and inserted in the groove of the wrench body to prevent the lid from detaching from the wrench body. The second elastic element is provided with a ball to engage with the switch of the switch assembly. The present invention utilizes the stud of the switch assembly to slide along the through slot of the lid and the engaging block to link the detent. The two elastic elements are to secure the ratchet and the switch assembly in position.

DETAILED DESCRIPTION OF THE PREFERRED EMBODIMENT

Figure 1:
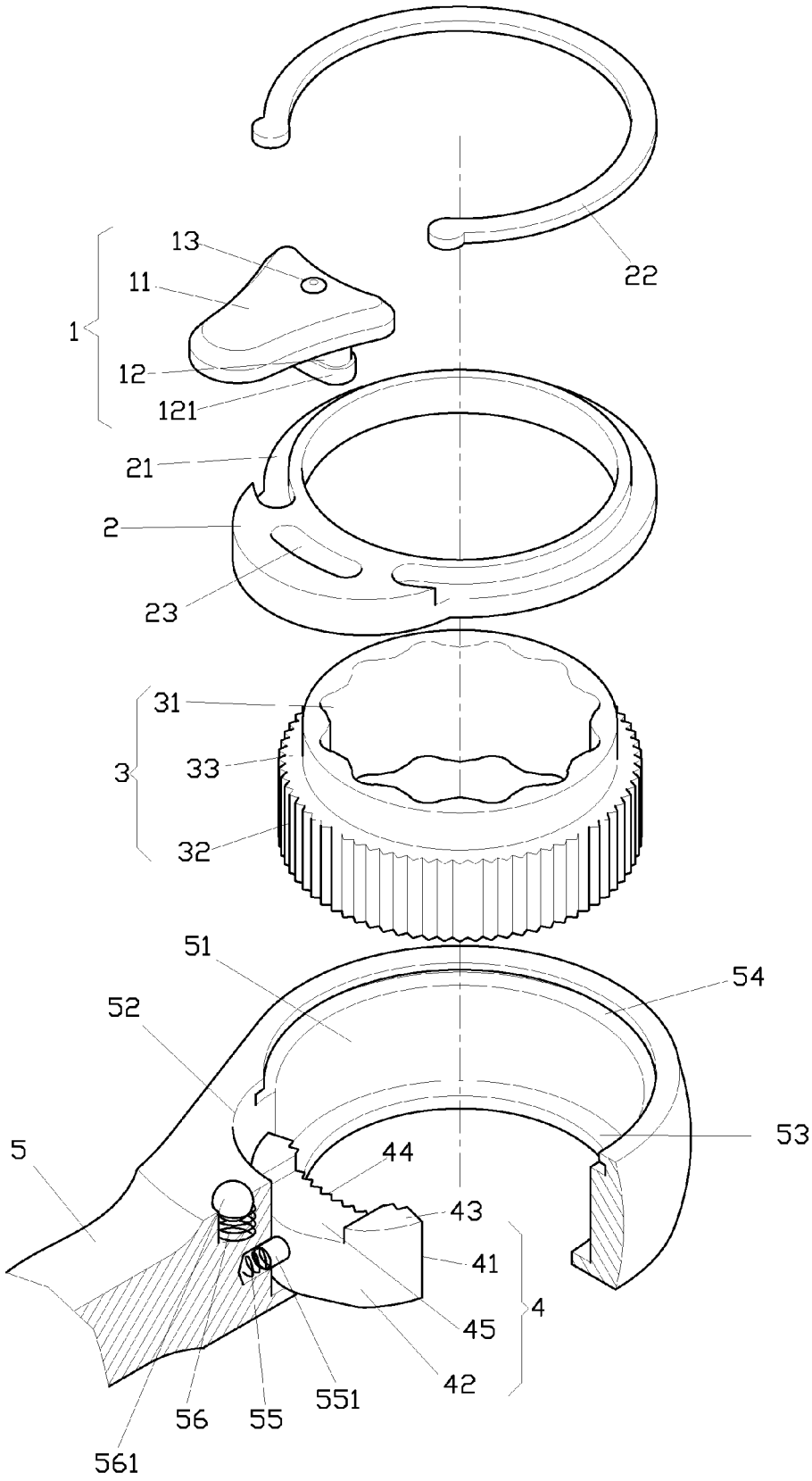
FIG. 1 is an exploded view of the present invention.
Figure 2:
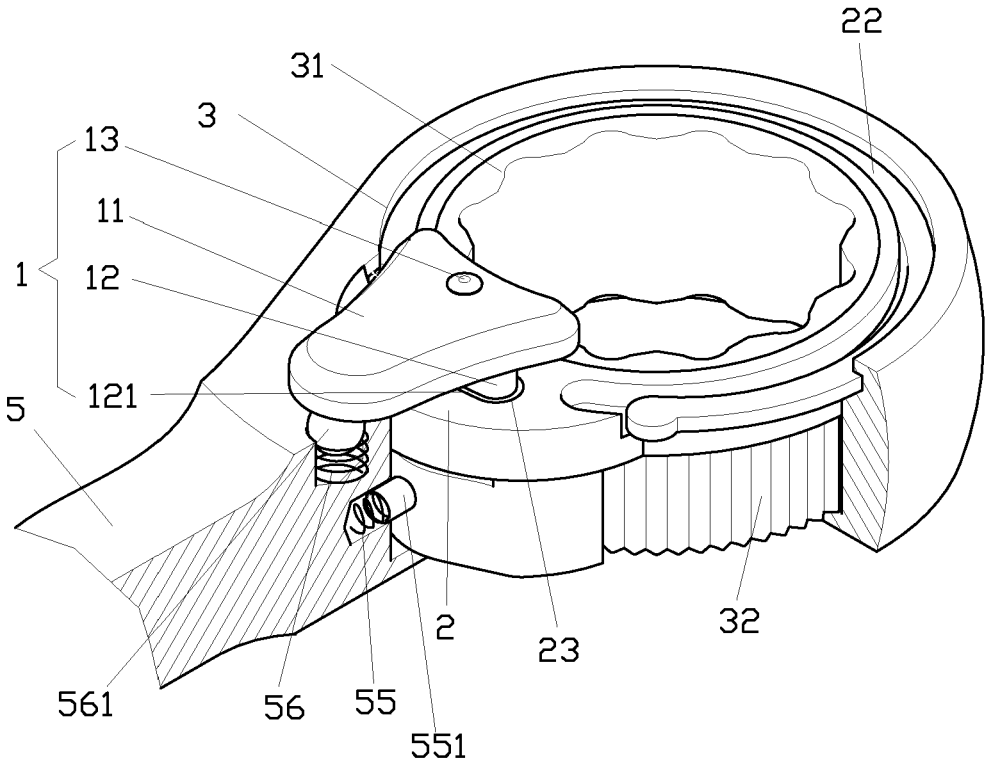
FIG. 2 is a perspective view of the present invention, partially sectioned.

As shown in FIGS. 1 and 2, a preferred embodiment of the present invention comprises a switch assembly 1, a lid 2, a ratchet 3, a detent 4, and a wrench body 5.

The switch assembly 1 comprises a switch 11 and a stud 12 extending downward from the switch 11. The stud 12 comprises an engaging block 121 which is secured by a fastener 13 to the switch 11.

The lid 2 comprises a first reduced section 21, a fastening member 22, and a through slot 23 for the stud 12 to be inserted therethrough. The fastening member 22 is a C-shaped clip, and the first reduced section 21 is also C-shaped corresponding to the fastening member 22.

The ratchet 3 comprises a through hole 31 to receive a hexagon sleeve or any other sleeve therein. The ratchet 3 is provided with gear teeth 32 and a second reduced section 33 around its outer periphery.

The detent 4 comprises a front end 41, a relative rear end 42 and an upper side 43 between the front end 41 and the rear end 42. The front end 41 is formed with gear teeth 44. The upper side 43 is formed with a trough 45 for the engaging block 121 of the stud 12 to be secured therein.

The wrench body 5 comprises a chamber 51, a recess 52, a block ring 53, a groove 54, a first elastic element 55 and a second elastic element 56. The chamber 51 interconnects with the recess 52. The block ring 53 is disposed in a lower portion of the wrench body 5, and the groove 54 is disposed in an upper portion of the wrench body 5. The ratchet 3 is accommodated in the chamber 51 and confined by the block ring 53. The recess 52 is to receive the detent 4 therein. The first elastic element 55 is provided with a sleeve 551 to engage with the detent 4 and urges the gear teeth 44 to mesh with the gear teeth 32 of the ratchet 3.

The lid 2 seats on the second reduced section 33 of the ratchet 3 and covers the detent 4. The fastening member 22 is disposed on the first reduced section 21 and inserted in the groove 54 to prevent the lid 2 detaching from the wrench body 5. The second elastic element 56 is provided with a ball 561 to engage with the switch 11 of the switch assembly 1.

By operating the switch assembly 1, the engaging block 121 of the stud 12 links the detent 4 to move. When the detent 4 reaches to its position, the rear end of the switch 11 does not cover the second elastic element 56, instead, the second elastic element 56 engages with the outer edge of the rear end of the switch 11. The first elastic element 55 urges the gear teeth 44 of the detent 4 to mesh with the gear teeth 32 of the ratchet 3.

Figure 3:
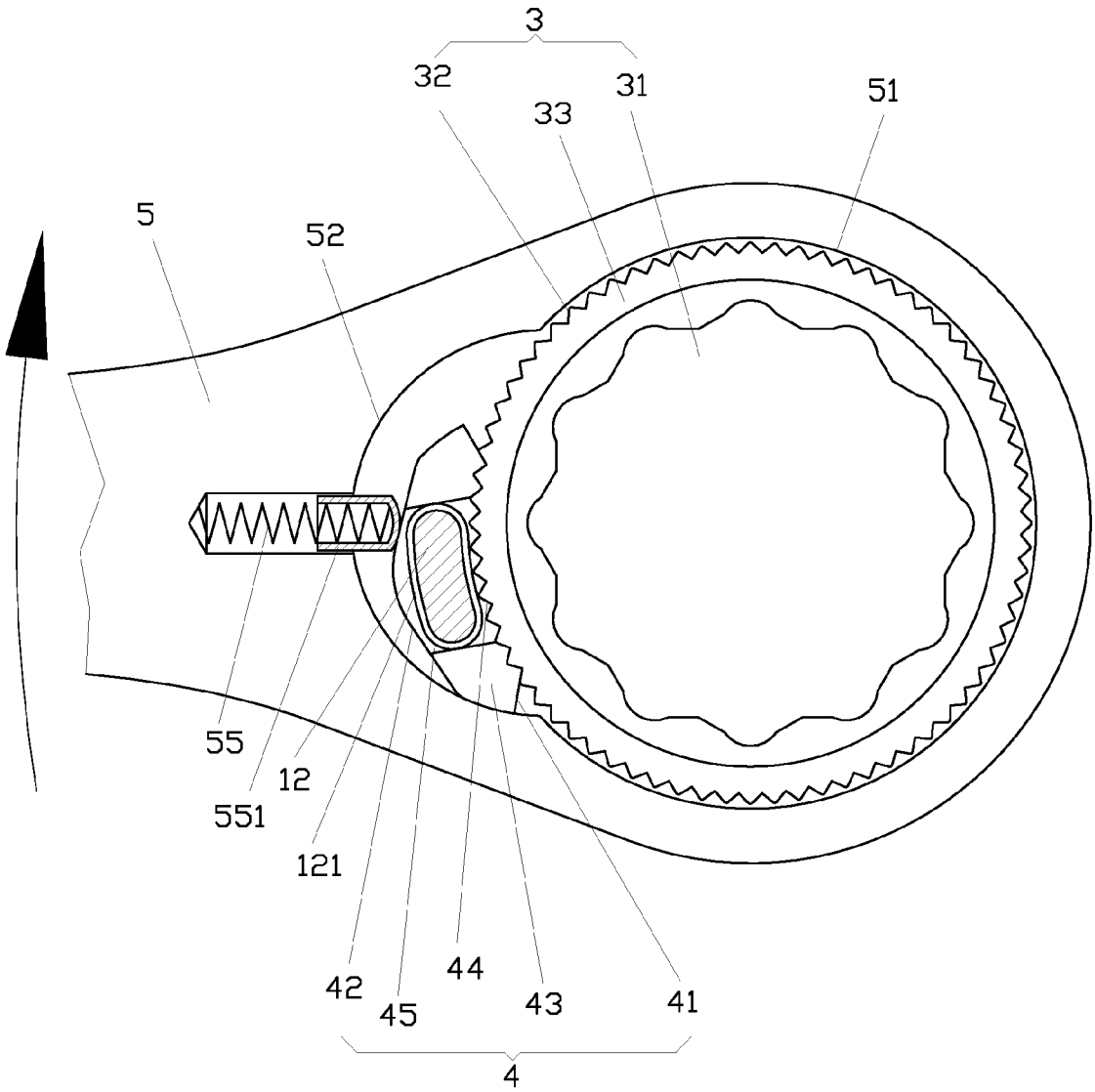
FIG. 3 is a top sectional view of the present invention in a clockwise operational status.

When the wrench body 5 is operated in a clockwise direction, as shown in FIG. 3, the recess 52 in the wrench body 5 has its inner wall against the detent 4, which forces the gear teeth 44 of the detent 4 to mesh with the gear teeth 32 of the ratchet 3 so as to link the ratchet 3 with the tool head in the through hole 31 of the ratchet 3 to turn clockwise.

When the wrench body 5 is turned in a counterclockwise direction, the gear teeth 44 of the detent 4 is forced by the gear teeth 32 of the ratchet 3 to retract, which then presses the first elastic element 55, thus the force from the wrench body 5 is unable to transfer to the ratchet 3. The ratchet 3 with the tool head will be turned idly. The operation to turn a tool head is simple and easy.

Figure 4:
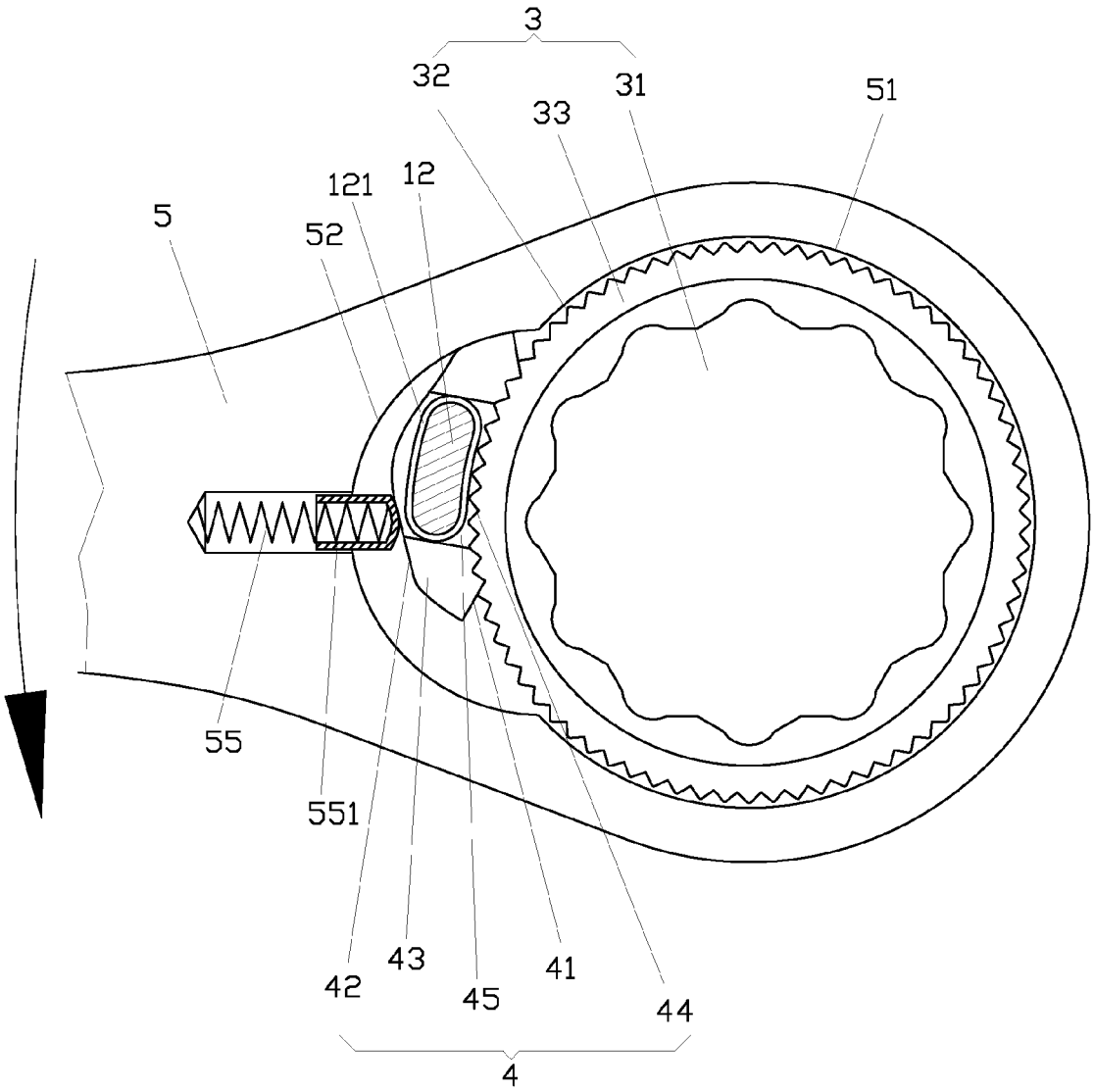
FIG. 4 is a top sectional view of the present invention in a counterclockwise operational status.

To operate the present invention in a counterclockwise direction, as shown in FIG. 4, the principle is similar to the clockwise operation, and it will not be described herein.

Thus, specific embodiments and applications of positioning device for a two-way ratchet tool have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refer to at least one of something selected from the group consisting of A, B, C . . . and N, the text should be interpreted as requiring only one element from the group, not A plus N, or B plus N, etc.

What is claimed is:

1. A positioning device for a two-way ratchet tool comprising:

a switch assembly comprising a switch and a stud extending from said switch, said stud comprising an engaging block thereof;

a lid comprising a first reduced section, a through slot, and a fastening member corresponding to said first reduced section, said stud of said switch assembly being inserted into said through slot and sliding therealong;

a ratchet comprising a through hole therein and having gear teeth and a second reduced section around its outer periphery;

a detent having a front end, a relative rear end, and an upper side between said front end and said rear end, said front end being formed with gear teeth, said upper side surface being formed with a trough to accommodate said engaging block of said stud of said switch assembly; and a wrench body comprising a chamber, a recess, a block ring, a groove, a first elastic element and a second elastic element, said recess interconnecting with said chamber, said block ring being disposed in a lower portion of said wrench body and said groove being disposed in an upper portion of said wrench body, said ratchet being accommodated in said chamber and confined by said block ring, said detent being accommodated in said recess, said first elastic element urging said gear teeth of said detent to mesh with said gear teeth of said ratchet, said lid being disposed on said second reduced section of said ratchet and covering said detent, said fastening member being disposed on said first reduced section of said lid and inserted in said groove of said wrench body to prevent said lid detaching from said wrench body, said second elastic element engaging with said switch of said switch assembly.

2. The positioning device for a two-way ratchet tool, as recited in claim 1, wherein said fastening member is a C-shaped clip, and said first reduced section is C-shaped corresponding to said fastening member.

3. The positioning device for a two-way ratchet tool, as recited in claim 1, wherein said first elastic element is provided with a sleeve to engage with said detent.

4. The positioning device for a two-way ratchet tool, as recited in claim 1, wherein said second elastic element is provided with a ball to engage with said switch.

* * * * *